United States Patent [19]

Bosch et al.

[11] 4,230,357

[45] Oct. 28, 1980

[54] TOOL FOR MANUAL RELOCATION OF ELECTRICAL CABLES

[75] Inventors: Mahlon L. Bosch; Marvin D. McKelvy, both of Centralia, Mo.

[73] Assignee: A. B. Chance Company, Centralia, Mo.

[21] Appl. No.: 1,169

[22] Filed: Jan. 5, 1979

[51] Int. Cl.[3] ..... B25B 27/00

[52] U.S. Cl. ..... 294/19 R; 81/53.1

[58] Field of Search ..... 294/19 A, 19 R, 23, 294/29, 34, 100, 103, 115; 81/3.8, 53.1; 119/151, 153

[56] References Cited

U.S. PATENT DOCUMENTS

| | | | |
|---|---|---|---|
| 3,433,521 | 3/1969 | Lasko | 294/19 R |
| 3,868,136 | 2/1975 | Schweitzer, Jr. | 294/19 R |
| 4,019,769 | 4/1977 | Filion | 294/19 R |

*Primary Examiner*—James B. Marbert

*Attorney, Agent, or Firm*—Schmidt, Johnson, Hovey & Williams

[57] ABSTRACT

A tool for safe, manual shifting and manipulation of energized lines is provided which finds special utility in mines or other close areas where conditions of moisture and the like make it mandatory that electrical equipment be handled with great care. The tool includes an elongated, insulative rod having, adjacent one end thereof, a pair of spaced, opposed, fixed, hook-like, spiral, cable-engaging fingers. In use, the fingers are placed astride an electric cable or the like and the rod is rotated axially so that the fingers pass under and cooperatively engage and capture the cable therebetween, thus permitting easy shifting and movement of the cable. Particular features of the tool include the complete elimination of any mechanical moving parts, and the special configuration of the cable-engaging fingers permitting easy lateral shifting of a cable without fear that the cable will become disengaged and fall free of the tool.

3 Claims, 4 Drawing Figures

TOOL FOR MANUAL RELOCATION OF ELECTRICAL CABLES

BACKGROUND OF THE INVENTION

1. Field of the Invention

The present invention relates to a simplified cable pickup and manipulative tool especially designed for safe and easy handling of elongated electrical cables and the like. More particularly, it is concerned with such a tool having an elongated, insulative rod, and cable pickup structure secured adjacent one end of the latter which preferably includes a pair of arcuate, spiral, hook-like, cable-engaging fingers such that the tool can be rotated axially to pick up and captively engage a cable, whereupon the latter can be moved and shifted as necessary.

2. Description of the Prior Art

Work in mines and other subterranean excavations demands exclusive use of electrical equipment, inasmuch as the exhaust from gasoline powered motors and engines cannot be tolerated in these areas. As a consequence, the practice has long been to string very long high voltage cables into mines for hookup with the equipment being used therein. At the same time however, the confined area and mine working conditions do not admit of storing such cables in a safe, permanent location. Hence, it very often occurs that mine workers must manually shift and move electrical cables. To give but one example, when electrical equipment is moved deeper underground in a mining operation, it is necessary to pick up the electrical cables and pull these along with the equipment.

In the past, cable movement has been accomplished simply by having mine workers manually grasp the cables and move them to a desired location. This practice has a number of obvious and serious drawbacks. First, rough and rocky conditions within mine shafts tend to abrade and even break the insulation provided about the highly energized (normally 440 volt) electrical cables; and this in turn makes it extremely hazardous for workers to manually pick up and handle the cables. This problem is further compounded by virtue of the wet conditions often encountered in mines, which of course tends to heighten the possibility of electric shock.

SUMMARY OF THE INVENTION

The difficulties described above are in large measure overcome by the present invention which provides a safe and effective, yet simplified tool for handling of electrical cables and the like. The tool broadly includes an elongated rod formed of an insulative material, with cable pickup structure secured adjacent one end of the rod. The pickup structure includes at least one fixed-position cable lifting finger which is configured for sliding under and supporting a cable. In preferred forms, a pair of fixed, arcuate, spiral, hook-like cable-engaging fingers are provided which are configured such that the tool can be rotated axially so that the fingers slide under and lift an electrical cable, and ultimately capture the cable between the fingers to prevent inadvertent cable slippage.

DESCRIPTION OF THE PREFERRED EMBODIMENT

Figure 1:
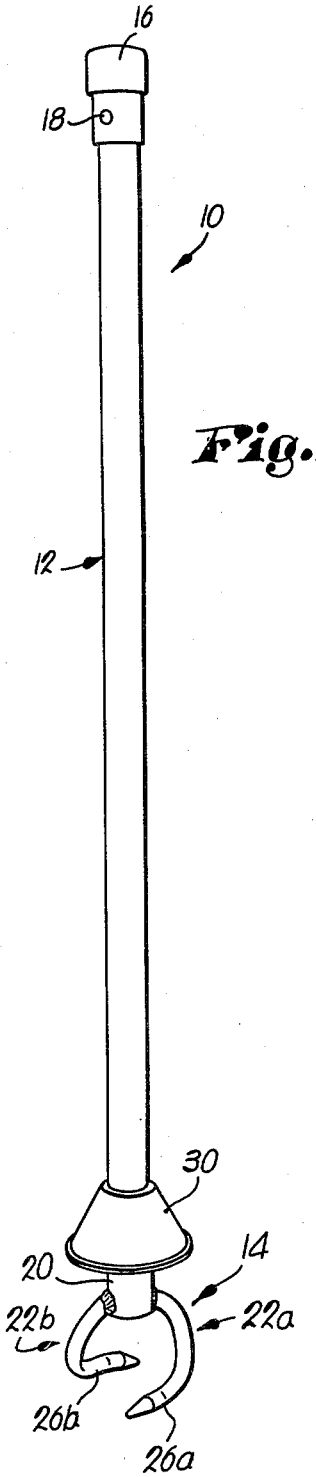
FIG. 1 is a side elevational view of a tool in accordance with the invention.

Referring now to the drawing, a cable tool 10 in accordance with the invention broadly includes an elongated rod 12 formed of synthetic resin, electrically insulative material, and cable pickup structure broadly referred to by the numeral 14 secured to rod 12 adjacent the lowermost end thereof.

In the embodiment illustrated in FIG. 1, rod 12 was formed of a known epoxy resin material having high electrical insulative qualities. A synthetic resin cap 16 is provided at the uppermost end of the rod 12 and is larger in cross-sectional dimensions than the latter so as to give the user a definite indication of the length of the rod, even in darkened mine shafts and the like. A transverse aperture 18 is provided through cap 16, to allow insertion of a thong handle to further facilitate carrying and use of the tool 10.

Figure 2:
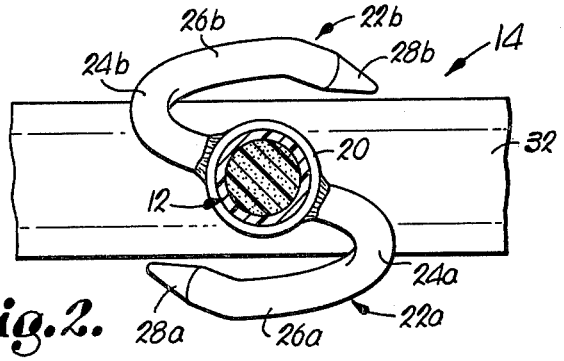
FIG. 2 is a sectional view illustrating the cable-engaging fingers of the tool in straddling relationship to an elongated electrical cable.
Figure 3:
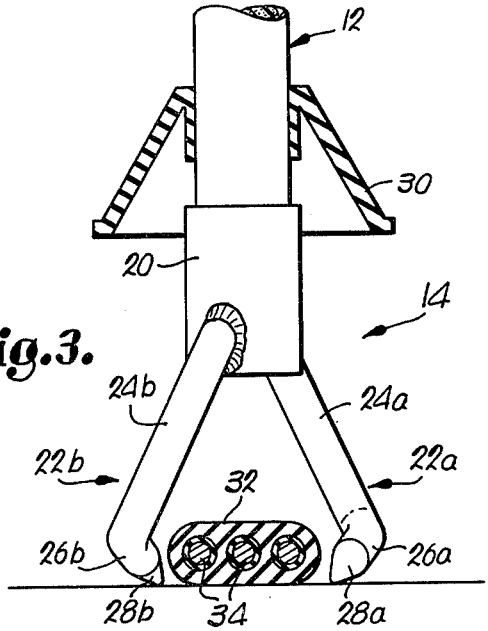
FIG. 3 is a fragmentary sectional view further illustrating the construction of the cable pickup end of the tool prior to rotation of the tool for cable pickup purposes.
Figure 4:
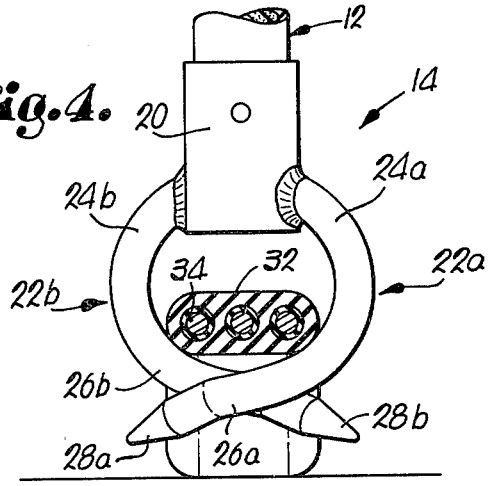
FIG. 4 is a view similar to that of FIG. 3, but illustrating the tool during use thereof with an electrical cable captively located between the cable-engaging fingers.

Pickup structure 14 includes a metallic ferrule 20 bonded to the lowermost end of rod 12. A pair of cooperating, fixed position, cable-lifting fingers **22*a* and 22*b* are welded to ferrule 20. The fingers 22*a* and 22*b* are in spaced, opposed relationship to one another. Each of the fingers has an obliquely oriented, arcuate portion 24*a*, 24*b*, as well as an integral, cable-engaging and lifting portion 26*a*, 26*b*. Finally, each finger terminates in a tapered, conical end 28*a*, 28*b*. As best seen in FIGS. 2 and 3, the ends 28*a*, 28*b* are turned inwardly toward each other, and are moreover turned downwardly relative to the corresponding portions 26*a*, 26*b*. As best seen in FIGS. 3 and 4, the cable-engaging portions 26*a*, 26*b*, of the respective fingers are in spaced relationship to the lowermost end of rod 12; moreover, these portions are spaced from one another in a transverse direction relative to the longitudinal axis of the rod 2. In essence, the fingers 22*a*, 22*b***, cooperatively define what amounts to a segment of a spiral or helix.

A downwardly opening, generally frustoconical insulative flexible guard 30 is disposed about rod 12 adjacent ferrule 20. The guard 30 helps to ensure a contaminant-free area on the rod and further helps to restrict movement of a worker's hand near the energized cable carried by the tool.

Referring now to FIGS. 2–4, use of the tool 10 will be explained. Specifically, the tool 10 is designed to manipulate energized cables such as an elongated cable 32 which is typically about 2½" wide and 1" thick and carries multiple energized conductors 34.

In use, the tool 10 is first placed astride the cable 32 with the respective fingers **22*a*, 22*b* being oriented in straddling relationship to the cable (see FIGS. 2 and 3). In this orientation the pointed ends 28*a*, 28*b* of the fingers are adjacent the opposite sides of the cable 32 and are in effect "turned in" toward the cable body so as to facilitate an easy sliding movement of the respective fingers under the cable. The turned down disposition of ends 28***a*, 28*b* further serves to ease rotation of the cable-engaging fingers without hangup.

After the tool is initially oriented it is only necessary to rotate tool 10 axially (i.e., about the longitudinal axis of rod 12), which serves to rotate the respective fingers 22*a*, 22*b* under the cable 32 to begin engaging and lifting the latter. When the tool has been rotated a full 90°, the condition illustrated in FIG. 4 exists, where the respective cable engaging portions 26*a*, 26*b* are disposed generally transverse to the longitudinal axis of cable 32 and are in spaced relationship to one another. Moreover, the respective fingers in this orientation cooperatively surround and entrap the cable 32, so that it is virtually impossible for the cable to become dislodged from the tool 10 without counter rotation of the rod 12. When the cable 32 has been so engaged and lifted by the rotation of rod 12, the cable can be shifted as necessary to accommodate conditions within the mine or the like. In this regard, the configuration of the fingers 22*a*, 22*b*, allows tilting of the tool during use thereof since the cable is contained and entrapped within what amounts to a full loop defined by the fingers. Hence, the tool can be used to shift a cable to a very restricted location without fear of inadvertent contact with the energized line.

Although the device of the present invention is believed to have greatest usefulness in connection with shifting of underground cables as explained, it can also be used above ground in many applications where it is necessary to handle energized conductors. In addition, the devices in accordance with the invention can be used for handling flexible conduits carrying various types of potentially hazardous materials such as acids or very hot or cold liquids.

Having thus described the invention, what is claimed as new and desired to be secured by letters patent is:

1. A cable tool, comprising:

an elongated rod;

cable pick up structure secured to said rod adjacent one end thereof and including a pair of cable-lifting fingers fixedly attached to said rod and in spaced, generally opposed relationship to one another, each of said fingers having an arcuate section and a terminal section, said terminal section including a substantially rectilinear segment oriented at an angle relative to the adjacent portion of said arcuate section, said segments also being oriented in a downward direction, away from the end of said rod, and inwardly toward one another.

2. The tool as set forth in claim 1 wherein said terminal sections are tapered on the end thereof for sliding under a cable.

3. The tool as set forth in claim 1 including a downwardly opening, generally frusto-conical insulative guard disposed about said rod proximal to said one end.

* * * * *